US005359791A

United States Patent [19]

Prahl et al.

[11] Patent Number: 5,359,791

[45] Date of Patent: Nov. 1, 1994

[54] ARCH SUPPORT FOR BEDDING LOAD-SENSITIVE FEET

[75] Inventors: Jan Prahl, Rullstorf; Jean P. Comtesse, Adendorf, both of Germany

[73] Assignee: IPOS GmbH & Co. KG, Luneburg, Germany

[21] Appl. No.: 92,663

[22] Filed: Jul. 15, 1993

Related U.S. Application Data

[63] Continuation of Ser. No. 799,540, Nov. 27, 1991, abandoned.

[30] Foreign Application Priority Data

Jan. 12, 1991 [DE] Germany ..... 9100326

[51] Int. Cl.[5] ..... A61F 5/14; A43B 13/38

[52] U.S. Cl. ..... 36/145; 36/44; 36/154

[58] Field of Search ..... 36/44, 91, 140, 141, 36/153, 154, 108, 178, 181, 145

[56] References Cited

U.S. PATENT DOCUMENTS

| | | | |
|---|---|---|---|
| 280,627 | 7/1883 | Jenkins | 36/44 X |
| 975,576 | 11/1910 | Sexton | 36/140 X |
| 1,236,924 | 8/1917 | Golden | 36/44 X |
| 1,630,135 | 5/1927 | Roberts | 36/44 |
| 2,330,398 | 9/1943 | Vass | 36/91 X |
| 2,826,834 | 3/1958 | Ratcliff | 36/173 |
| 3,416,245 | 12/1968 | Ferteira | 36/44 |
| 4,055,699 | 10/1977 | Hsiung | 36/44 |
| 4,378,642 | 4/1983 | Light et al. | 36/35 R |
| 4,510,699 | 4/1985 | Nakamura et al. | 36/43 |
| 4,689,898 | 9/1987 | Fahey | 36/91 X |
| 4,716,662 | 1/1988 | Bar | 36/91 X |
| 4,876,805 | 10/1989 | Peoples | 36/24.5 X |
| 4,928,404 | 5/1990 | Scheurmann | 36/71 X |
| 5,101,580 | 4/1992 | Lyden | 36/43 X |

*Primary Examiner*—Paul T. Sewell
*Assistant Examiner*—Ted Kavanaugh
*Attorney, Agent, or Firm*—Townsend and Townsend Khourie and Crew

[57] ABSTRACT

A therapeutic arch support is described, more particularly intended for therapy of disorders of the circulation of the foot, for the treatment of venous insufficiency within the area of the leg or for bedding load-sensitive feet, especially for bedding the feet of diabetics suffering from foot detects. The arch support has a multilayer construction with a highly resilient elastomer core layer standardized so as to be as soft as possible and a thin, top-side covering layer in the form of a smooth fibrous structure. On the side of the sole, a separate supporting layer of flexible, machinable and compression-resistant material may be provided. The therapeutic arch support is distinguished by effectively supporting the back flow circulation when walking on the one hand and, on the other, in that it, while being economical to manufacture, supports the foot apparatus that is optimally adapted to the respective individual requirements in such a way that, when walking, as normal as possible and, therewith, pain-free loading situations arise, even when the foot already suffers from an advanced muscular atrophy within the area of the metacarpal phalangeal joints due to an impaired capillary circulation.

2 Claims, 1 Drawing Sheet

ARCH SUPPORT FOR BEDDING LOAD-SENSITIVE FEET

This is a continuation Ser. No. 07/799,540, filed Nov. 27, 1991, now abandoned.

The present invention relates to a therapeutic arch support, e.g. for providing a bed for load-sensitive feet of persons suffering from foot defects such as those common to diabetics. Arch supports of this type are employed in particular for therapy in disorders of the circulation of the foot, for the treatment of venous insufficiency within the region of the leg or for bedding load-sensitive feet, by way of example, within the sector of orthopedics for the compensation of malformations of the foot apparatus or system or for specifically supporting the foot of a sick or handicapped person during the rolling phase of the foot. Therapeutic arch supports are also necessary for providing a foot bedding as it were for diabetics suffering from foot defects where it is a matter of making use of the arch support not merely for eliminating the algogenic pressure zones but, in addition, in order to support the musculoskeletal system as well as the blood circulation by means of a functional supplement for the weakened musculature.

BACKGROUND OF THE INVENTION

It is known that disorders of the circulation of the foot are, on the one hand, widespread and have a significant influence on the return circulation even when no clinical and evident symptoms of the disorders of the circulation exist. Repercussions on the circulation are of too great an importance, metabolic disorders and-in women-the menstrual cycle and the pregnancy. On the other hand, it has to be stated that such, in the beginning, minor anomalies in the circulation of the foot, in the majority of cases, do not receive any treatment. The reason for this, on the one hand, is to be found in the circumstance that, in the initial phase of the illness, which can already be traced in young patients, such anomalies are not detected. A further reason has to be seen in that conventional devices for the correction of these anomalies do not meet the requirements of the patients and, for that reason, do not find acceptance. This applies e.g. to leg dressings which are especially unpopular with young people for the reason alone that, even in the form of a light or medium fixed bandage, they are more or less bulky and thus unsightly and therefore impose severe restriction more particularly upon the fashion-conscious patient with regard to the choice of clothing.

Also conventional arch supports are only conditionally suitable for the therapy of phlebological illnesses or for providing a bed for feet that are sensitive to loads, as are e.g. defective feet of diabetics, for a great many demands are made on such an arch support.

On the one hand, care has to be taken that the user who, as far as the mobility of his foot is concerned, is already more or less seriously restricted, is capable of stepping effortlessly into the shoe. On the other, the arch support should be constituted in such a way that it is capable of compensating or offsetting the muscular atrophy regularly produced by the impaired venous and/or capillary circulation within the area of the foot or to promote the retrogression of this muscular asthenia. Finally, in arch supports of this kind, a further aspect consists in that, in an economical manufacturing process, as many possibilities as possible exist for accordingly optimally adapting the arch support to the individual marginal conditions, i.e. to the, in each case, existing configuration and illnesses of the foot.

These criteria and objectives pointed out above are, in part, contradictory. A conventional arch support which was capable of being adapted to the in each case existing clinical picture of the foot was equipped with a relatively rigid frame that was intended to first and foremost provide the foot with a sound support. Apart from the fact that such an arch support had to be renewed at short intervals so as to undergo an adaptation to the changing bed or base of the foot, such an arch support is not suited for the therapy of the feet of diabetics which, due to illness, have undergone a change. Diabetic feet commonly have a tendency of developing hammer and claw toes. This has as a result that, when conventional arch supports are used, when the foot is inserted, it rolls itself into the shoe whereby extremely unfavorable stress situations arise which are very painful. More particularly, in this conventional arch support, no allowance is made for the, in the diabetic foot, frequently very marked muscular atrophy within the zone of the metacarpal phalangeal joints, with the aid of which the rolling load is absorbed when walking. That is why the invention is based upon the technical problem of providing a therapeutic arch support, more particularly for therapy in cases where disorders of the foot circulation are involved, for treatment of the venous insufficiency within the region of the leg and for providing a bed so to speak for feet that are sensitive to load and stress, such as e.g. the foot of a diabetic, which not only possesses an excellent therapeutic effect for the scopes of application stated in the foregoing, but, over and above that, is constructed in such a way that, white being economic to manufacture, is accepted by a wide section of patients. This technical problem is solved by the arch support.

SUMMARY OF THE INVENTION

According to the invention, an arch support which is of simple construction is provided, the deformational behavior of which is determined by the core layer in such a way that the arch support acts with each step like a pressure pump on the venous circulation. The deep-seated veins of the calf are thereby filled up to the maximal capacity and are subsequently evacuated again by the muscular pressure of the calf, the blood being urged upwardly in the process. In tests, due to the homogeneously elastic bedding of the foot, blood return flow values increases of from 60 to 70% resulted, with which it was possible to even exceed the effect achieved by means of elastic stockings and bandages. The essential advantage of the invention has to be seen here in that the arch support can be worn without hesitation by everybody, thus e.g. also by younger, more fashion-conscious patients especially since it has been shown that the arch support exhibits the aforementioned advantageous effects with a very small thickness of the support.

Tests were performed involving patients of the age group of between 19 and 23 years with the arch support according to the invention in whose cases an incipient venous insufficiency had become apparent which made itself felt essentially by a functional symptomatology in the form of clumsiness, restlessness, burning sensation, pains, isolated edmas of the ankle, cramps and parethesias. The wearing of the arch support according to the invention resulted in all the patients in a significant reduction in the intensity of the subjectively felt and functional disorders, in which connection it was possible to note the best results regarding the symptoms of clumsiness, cramps and leg pains in the evening, as well with regard to paresthesia. It was also possible in connection with support and fixed dressings to ascertain an additional enhancement of the therapeutic effect due to the arch support according to the invention, in particular a reduction of the edemas. Since the resilience inherent in the elastomer core layer returns a part of the energy which is first of all absorbed by the arch support, to the walking process, not only the described "pressure pump effect" for the improvement of the return circulation is increased, but, beyond that, it is possible to selectively supplement again a muscular asthenia or a muscular atrophy in an elastic manner where it is of the greatest importance for the rolling action of the foot. By means of a suitable harmonization of the elastomer core layer density or of the degree of hardness of this layer, the construction according to the invention of the arch support is suited for an economical production of corrective arch supports for the specific phlebological treatment.

Particularly advantageous results can be achieved with a standardization of the elastomer core layer in which case silicon rubber is employed by preference as material for preserving the specific degree of hardness standardization.

With the arch support according to the invention it is also possible to fabricate a particularly advantageous product for load-sensitive feet, more particularly for bedding the feet of diabetics suffering from foot defects. The more or less strongly marked muscular atrophy in the diabetic foot within the area of the metacarpal phalangeal joints is not only very largely compensated by the therapeutic arch support. For it has even turned out additionally that the deformation behavior of the arch support according to the invention is suitable even for therapeutically counteracting the muscular asthenia. In this connection it is possible to construct the arch support with or without additional supporting layer on the side of the sole which differs material-wise from the elastomer core layer. If the supporting layer is omitted, however, then it is certainty of advantage to increase the elastomer core layer thickness by e.g. 2 mm in order to improve the elastic recovery capacity still further. When using an additional supporting layer on the side of the sole, a large-area support for the elastomer core layer is provided whose material properties may be selected with a view to an optimal, i.e. highly resilient support of the foot. By preference, into the underside of the layer on the side of the sole, preferably a separate supporting layer, a relief adapted to the individual requirements of the arch support wearer is incorporated or machined in. When employing a separate supporting layer, it is possible to select the relief on the side of the sole which forms the machined-in impressions or recesses independently of the elastic standardization of the elastomer core layer. It is possible at any rate, by means of the incorporation or machining in of a profile into the side of the sole adapted to the individual forms of illness the foot is subject to, to specifically affect the elasticity of the arch support or to relieve pressure-endangered zones of the foot with accuracy. The surface layer on the top side in the form of the smooth fiber structure does offer so little resistance to even the naked foot when inserting it into the shoe that malposition of the toes does not occur even when the foot has a tendency to develop hammer or claw toes. By means of the continuous layer construction of the arch support it is possible to realize the advantages to which attention has been drawn in the foregoing with a very simple and, due to this, inexpensive manufacturing process. The arch support is suitable for mass production.

It has turned out that it was possible to achieve the best results with an elastomer core layer whose hardness lies within the range of between 1° and 10° Shore A, preferably - in the case of a double-layer construction - at approximately 8° Shore A, it being possible to standardize the degree of hardness when a separate layer is used so as to be somewhat lower than when employing a double-layer arch support construction. A material standardized in this way has an almost gel-like behavior when subjected to a load, i.e. it adapts itself to the shape of the foot over as large an area as possible and makes available adequate elasticity at critical points for supporting the rolling action or movement of the foot. Elastomers of this type are known. A particularly advantageous material is an addition cross linking silicon rubber material. The resilient elastomer core layer can be made of cross-linking, almost gel-like-standardized silicon rubber material. Likewise, the covering layer can be comprised of a synthetic fiber material.

It has been discovered moreover that, when use is made of a supporting layer, a thickness within a range of from 1.5 mm and 3 mm suffices to leave adequate scope for the reworking of the supporting layer on the side of the sole which was mentioned in the foregoing. In this connection, when using cork as the material, the additional advantage results that the arch support is securely retained and prevented from slipping out of position inside the shoe. Furthermore, the cork plate is sufficiently flexible so as to permit the fitting of the arch support into the shoe.

When dispensing with a separate supporting layer, in that case it is of advantage to somewhat increase the thickness of the elastomer core layer, by way of example, to construct it so as to be thicker by approximately 2 mm than with a separate supporting layer on the side of the sole. In this case it is of additional advantage to standardize the plastic of the elastomer core layer to be slightly harder, e.g. to 8° Shore A. By means of this standardization it is also possible to provide the layer on the side of the sole, i.e. the underside of the arch support, with a relief adapted to the individual requirements of the person wearing the arch support.

It is possible to additionally control the deformational behavior by means of the connecting technique between the supporting layer on the side of the sole and the elastomer core layer. The supporting layer is preferably vulcanized onto the core layer, whereby a heavy-duty and fatigue-resistant connection is established.

The contact surfaces between the supporting layer on the sole side and the elastomer core layer located thereabove are preferably of plane configuration, whereby it is possible to additionally simplify the manufacturing process.

Especially good results with regard to as extensive a reduction as possible of the sliding resistance between the sole of the foot and the arch support can be achieved by means of a covering layer of synthetic fiber material. Particularly, where the covering the layer is a textile fabric which contains nylon or where the side of he sole is a material that can be machined by grinding over and above that a high level of resistance to wear results while, at the same time, a maximum degree of hygiene is provided since such materials can be easily cleaned.

A further possibility for controlling the deformational behavior of the arch support consists in forming the elastomer core layer on the top side in a relief-like fashion in such a way that it is to the greatest possible extent preadapted to the shape of the foot. Beyond that it is possible with this configuration to specifically influence requisite flexibilities within certain zones of the foot.

With the further development according to claim 18 it is possible to additionally intensify the therapeutic effect in the case of venous insufficiency since, owing to the configuration of the arch support - with or without a separate supporting layer - a good guidance of the heel exists during the rolling movement of the foot.

BRIEF DESCRIPTION OF THE DRAWINGS

With the aid of diagrammatical drawings, embodiment examples of the invention are explained in greater detail below. Thus

DESCRIPTION OF THE PREFERRED EMBODIMENT

In the figures, an arch support and/or insole is identified with 2 which possesses essentially the external contours of the sole of a shoe. The arch support serves to provide a bed as it were for load sensitive feet, such as e.g. for bedding the feet of diabetics which, due to an impaired capillary circulation, are frequently subject to a muscular atrophy.

Figure 1:
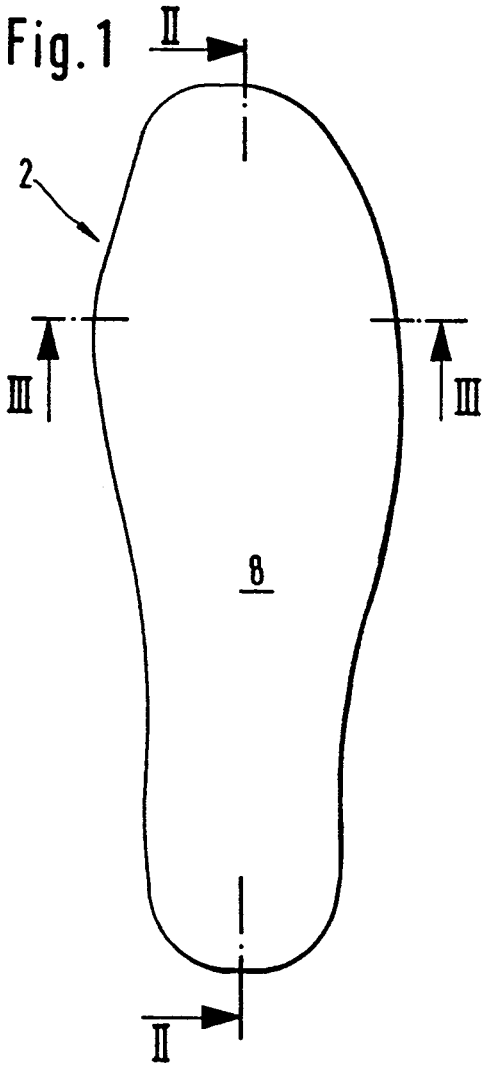
FIG. 1 shows a top view of the arch support.
Figure 2:
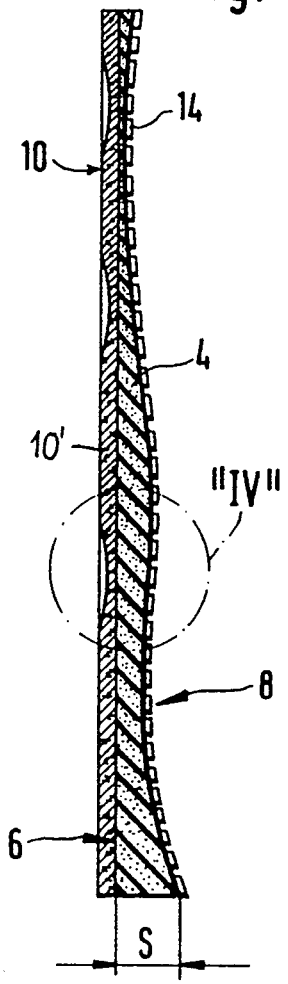
FIG. 2 shows the section in the direction of the line II—II i n FIG. 1.
Figure 3:
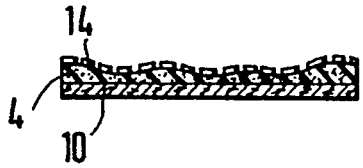
FIG. 3 shows the section in the direction of the line III—III in FIG. 1.
Figure 4:
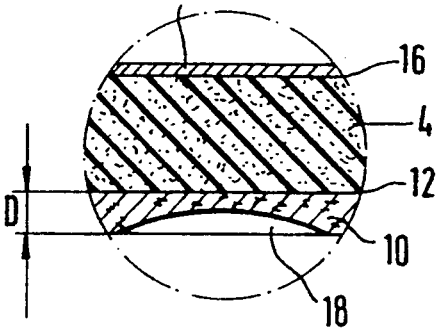
FIG. 4 shows the detail "IV" in FIG. 2.

As can be inferred in detail from the representation according to FIG. 4, the arch support is constructed in three layers. Essentially the arch support is comprised of a central elastomer core layer 4, in which case the elastomer is standardized so as to be as soft as possible. In the depicted embodiment the elastomer is selected from the group of addition cross-linking silicon rubbers, the standardization of the elastomer being effected in such a way that a practically gel-like deformation behavior is brought about. By preference, the Shore A hardness in this case lies within the range of from 1° to 10°, by way of example, at 1°. At the bottom, the elastomer core layer is provided with a plane surface 6, white, on the top side, it is provided with a relief structure 8, which appears from the sections according to the FIGS. 2 and 3. This relief structure 8 is preferably selected in such a way that it is adapted to the natural bed or base of the foot to a very large extent. On the bottom side, the elastomer core layer is connected by means of the plane surface 6 to a plate-like supporting layer 10 of flexible and compression-resistant material which, over and above that, possesses the property of being capable of being subjected to a reworking operation, e.g. in the form of a grinding process. In the concrete embodiment example, socalled "flexocork" is employed as material for the supporting layer, which is applied to the elastomer core layer with the aid of a vulcanization layer 12. The thickness D of the "flexocork" plate 10' lies within a range of between 1.5 mm and 3 mm. The thickness S of the elastomer core layer 4 varies over the length of the arch support 2 and lies, by way of example, between 1.5 mm within the area of the ball of the foot and up to 15 mm within the heel area.

On the top, the elastomer core layer 4 is covered by a thin covering layer 14 comprised of a synthetic fiber material, such as e.g. a textile fabric containing nylon which is commercially available under the designation "lycra". This is a rayon, with the aid of which a surface is provided which possesses a very high gliding or sailing ability. The covering layer 14 is preferably constructed in the form of a textile fabric fits particularly snugly to the relief structure 8 and which possesses relatively little bulk. With 16, an adhesive layer is identified, by means of which a connection between the elastomer core layer 4 and the covering layer 14 is established.

On the side of the sole, impressions or recesses can be perceived which are produced e.g. by a grinding machining of the supporting layer 10. This grinding operation is carried out by the orthopedist in order to adapt the arch support or the base or bed of the foot to the individual marginal conditions of the wearer of the arch support. It is possible to hereby relieve pressure-jeopardized zones on the affected foot with great accuracy in that, in an interaction between supporting layer 10 and elastomer core layer 4, the deformation behavior is influenced in a point-wise or area-wise manner.

The advantages of the bed of the foot according to the invention reside in particular in the circumstance that, with a simple construction first of all due to the very smooth covering layer 14, a very easy insertion of the affected foot into the shoe is rendered possible. It is for this reason that the foot bed is particularly well-suited for the therapy of the feet of diabetics which tend to be afflicted with hammer and claw toes.

Due to the elastomer having been standardized so as to be very soft, the muscular atrophy which frequently develops on account of an impaired capillary circulation is elastically counteracted, which is of particular importance within the area of the metacarpal phalangeal joints since it is there where the decisive processes for a trouble-free rolling movement of the foot take place.

By means of the machined recesses 18 it is possible to selectively control the elasticity so as to resiliently support the load-sensitive foot especially at points where this is of particular importance with regard to pressure-sensitivity and the essential motion pattern.

An embodiment example of the arch support with a triple-layer construction was described in the foregoing, this particular arch support being to a singular extent suited for the bedding of load-sensitive feet, more particularly for diabetics suffering from foot defects, but also for the treatment of venous insufficiency symptoms and where disorders of the venous functions exist.

Figure 5:
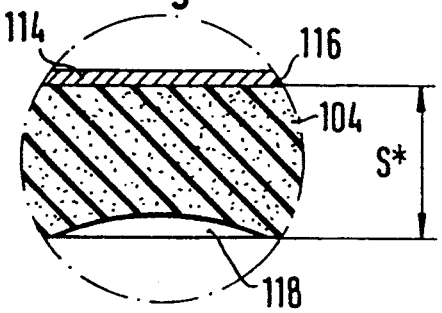
FIG. 5 shows a section similar to the FIG. 4 of a further embodiment of the arch support.

A further variant of the arch support, the manufacture of which is additionally simplified and which nonetheless meets the requirements for the aforementioned therapeutic functions for offsetting the effects of disorders of the circulation of the anatomy of the foot and/or leg, is diagrammatically shown in the FIG. 5.

In this embodiment, those components which correspond to the functional sections of the embodiment described previously, are identified with similar reference numbers that have been augmented by the figure "100". The variant according to FIG. 5 differs from the embodiment according to the FIGS. 1 through 4 in that a separate supporting layer 10 has been dispensed with. The elastomer core layer 14 which is connected to the covering layer 114 by means of the adhesive layer 116, possesses an accordingly increased thickness S*. In comparison with the embodiment according to the FIGS. 1 through 4, the thickness or diameter of the elastomer core layer 104 has been increased by approximately 2 mm. Within the sole area it is still possible for ground-in recesses 118 to be provided at individually adapted or predetermined points in order to adapt the elastic deformation behavior to the respective therapy program. It is of advantage in this connection to increase the hardness of the elastomer core layer 104 a little, preferably into the range of approximately 8° Shore A.

Also on the top side it is possible for the insole according to the variant per FIG. 5 to be provided with a relief structure, constructed by preference within the area of the heel with a more substantial recess, while the position and the dimension of the recess are advantageously adapted to the extent of the anomalous positions of the foot anatomy and/or to the degree of the venous insufficiency.

The invention thus provides a therapeutic arch support, more particularly for therapy in cases of disorders of the circulation of the foot, for the treatment of venous insufficiency within the area of the leg or for providing a bed as it were for load sensitive feet, especially for bedding the feet of diabetics suffering from foot defects.

The arch support has a multi-layer construction with a highly resilient elastomer core layer that is possibly standardized so as to be soft, and a thin top-side covering layer in the form of a smooth fiber structure. On the side of the sole, a separate supporting layer of resilient, machinable and compression-resistant material may be provided. The therapeutic arch support is distinguished by effectively supporting the blood return circulation when walking on the one hand and, on the other, that it, white being economical to manufacture, supports the foot apparatus in a way that is optimally adapted to the respective individual requirements in such a way that, when walking, as normal as possible and, therewith, pain-free local situations arise, even when the foot already suffers from an advanced muscular atrophy within the area of the metacarpal phalangeal joints due to an impaired capillary circulation.

What is claimed is:

1. A shoe insole for bedding load-sensitive feet of persons suffering from foot defects, said sole insole having a multi-layered structure comprised of:

a) a supporting layer (10) comprised of a flexible and compression-resistant material of a flexible cork plate (10'), and having a thickness (d) of 1.5 to 3 mm;

b) a highly resilient elastomer-core layer (4,104) applied to the supporting layer (10) having a thickness of 1.5 to 15 mm and comprised of an addition cross-linking, silicon rubber material with a Shore A hardness lying in the range of 1° to 10°, and in which the supporting layer (10) is vulcanized onto the elastomer-core layer (4,104); and, c) an upper covering layer (14,114) applied to the supporting layer (10) and comprised of a synthetic fiber material; in which, d) the contact surfaces (6) between the elastomercore layer (4) and the supporting layer (10) are plane, and e) the sole-shaped supporting layer (10) is provided with a recess (18) grounded out of said supporting layer so as to resiliently supports the load-sensitive feed.

2. Shoe insole for bedding load-sensitive feet according to claim 1 and wherein:

said addition cross-linking, silicon rubber material with a Shore A hardness 8°.

* * * * *